United States Patent [19]

Buschow et al.

[11] Patent Number: 5,062,907

[45] Date of Patent: Nov. 5, 1991

[54] HARD MAGNETIC MATERIAL AND MAGNET MANUFACTURED FROM SUCH HARD MAGNETIC MATERIAL

[75] Inventors: Kurt H. J. Buschow; Dirk B. de Mooij; Theodora H. Jacobs, all of Eindhoven, Netherlands

[73] Assignee: U.S. Philips Corp., New York, N.Y.

[21] Appl. No.: 518,900

[22] Filed: May 4, 1990

[30] Foreign Application Priority Data

May 10, 1989 [NL] Netherlands ..... 8901168

[51] Int. Cl.[5] ..... H01F 1/053

[52] U.S. Cl. ..... 148/301; 148/306

[58] Field of Search ..... 148/301, 302, 306; 420/83

[56] References Cited

FOREIGN PATENT DOCUMENTS

| | | | |
|---|---|---|---|
| 320064 | 6/1989 | European Pat. Off. | 148/301 |
| 67110 | 5/1980 | Japan . | |
| 3294 | 1/1983 | Japan | 148/301 |

*Primary Examiner*—R. Dean
*Assistant Examiner*—George Wyszomierski
*Attorney, Agent, or Firm*—Ernestine C. Bartlett

[57] ABSTRACT

A description is given of a hard magnetic material whose composition corresponds to the formula $RE_2Fe_{17}C_x$, RE consisting of at least 70 at. % of Sm. This material has a relatively large uniaxial magnetic anisotropy and a relatively high $T_c$ and is very suitable for use in permanent magnets.

5 Claims, 1 Drawing Sheet

HARD MAGNETIC MATERIAL AND MAGNET MANUFACTURED FROM SUCH HARD MAGNETIC MATERIAL

BACKGROUND OF THE INVENTION

The invention relates to magnetic material which comprises a magnetic phase which is composed mainly of crystalline RE The invention also relates to a magnet which is manufactured from this magnetic material.

Magnetic material of the type mentioned above is known from, inter alia, Ferromagnetic Materials, Edition E.P. Wohlfarth and K.H.J. Buschow, Elsevier Science Publishers B.V., Volume 4, pages 131–209, 1988. More in particular, on page 150 of said literature reference eleven $RE_2Fe_{17}$ compounds are represented (FIG. 11, x=1), wherein RE denotes the rare earth metals Ce, Pr, Nd, Sm, Gd, Dy, Er, Tm, Yb, Th and Y. These compounds have a hexagonal crystal structure of the $Th_2Ni_{17}$ type or the much related rhombohedral structure of the $Th_2Zn_{17}$ type. By virtue of the relatively high Fe content these compounds are interesting, in principle, for use as hard magnetic material in permanent magnets. The said Figure, however, shows that these $RE_2Fe_{17}$ compounds do not have a uniaxial magnetic anisotropy. Thus, they are unsuitable for use as permanent magnetic material.

One of the objects of the invention is to provide a magnetic material on the basis of $RE_2Fe_{17}$ compounds which has a relatively high uniaxial anisotropy at room temperature. A further object of the invention is to provide a permanent magnet which is manufactured from this material.

This object is achieved by a material of the type mentioned in the opening paragraph, which is characterized according to the invention in that interstitial C is dissolved in the magnetic phase, in a quantity which is sufficiently large to provide the magnetic material with a uniaxial magnetic anisotropy, and in that RE consists of at least 70 at.% of the rare earth metal Sm.

It has been found that the crystalline structure of the $RE_2Fe_{17}$ material hardly changes when interstitial C is dissolved therein. The $RE_2Fe_{17}C_x$ compounds also have a hexagonal structure of the $Th_2Ni_{17}$ type or the $Th_2Zn_{17}$ type. Further, the volume of the unit cell of $RE_2Fe_{17}C$ exceeds that of the unit cell of $RE_2Fe_{17}$ by only approximately 2%. An important consequence hereof is that no appreciable magnetic dilution occurs. Magnetic dilution is disadvantageous because it leads to a reduction of the saturation magnetization. Magnetic dilution would occur, in particular, when in the $RE_2Fe_{17}$ lattice C replaces one or more Fe atoms. Applicants have indications that dissolved C rather brings about an increase of the saturation magnetization.

Further, it has been found that at room temperature the uniaxial magnetic anisotropy of the C-containing $RE_2Fe_{17}$ compounds which do not contain a considerable quantity of Sm is negligibly small. Compounds of said type such as, for example, $Gd_2Fe_{17}C$ or $Y_2Fe_{17}C$ generally exhibit a so-called in-plane anisotropy, i.e., at room temperature the anisotropy direction of the material is not uniaxial, but extends perpendicularly to the crystallographic C-axis. This renders them unsuitable for use as hard magnetic material for permanent magnets.

It is to be noted that in J. Less-Common Met. 142 349–357 (1988), a description is given of a number of $Nd_2Fe_{17}C_x$ compounds. Said compounds have an in-plane anisotropy which even exceeds, that of $Nd2Fe_{17}$.

SUMMARY OF THE INVENTION

A preferred embodiment of the magnetic material according to the invention is characterized in that the composition of the hard magnetic phase corresponds to the formula $RE_2Fe_{17}C_x$, wherein $0.5<x<3.0$. When very small quantities of C are dissolved, i.e., $x-0.5$, the uniaxial anisotropy is relatively small. For various compounds of the type $Sm_2Fe_{17}C_x$, with $x>0.5$, it has been demonstrated by means of X-ray diffraction of magnetically orientated powders that the easy axis of magnetization extends parallel to the C-axis. It has been found that if more than 3 C-atoms per unit of $RE_2Fe_{17}$ are dissolved, multiphase material is obtained. In such a material not only the desired crystalline phase having the $Th_2Zn_{17}$ structure is present, but also undesired crystalline phases are present in substantial quantities. This results in a decrease of the uniaxial anisotropy. If less than two C-atoms per unit of $RE_2Fe_{17}$ are dissolved, purely single-phase material is obtained.

Further it has been found that in the case of $Sm_2Fe_{17}C_x$ compounds, the sublattice magnetizations of Sm and Fe are oriented parallel (ferromagnetic coupling), and consequently the overall magnetization is equal to the sum of the sublattice magnetizations. By virtue hereof, the $RE_2Fe_{17}C_x$ compounds according to the invention, wherein RE is substantially, i.e., more than 70 at.%, composed of Sm exhibit relatively high values of saturation magnetization. The highest values are attained by using $Sm_2Fe_{17}C_x$ compounds. It has been found that $Sm_2Fe_{17}C_x$ compounds with $1.0<x<1.5$ have the largest uniaxial anisotropy. A phenomenon which is also important is that the dissolution of C in $RE_2Fe_{17}$ compounds has a considerable influence on the value of the Curie temperature ($T_c$). The addition of 1 C-atom per unit of $RE_2Fe_{17}$ may lead to an increase of $T_c$by 200 K. When the $T_c$ (Curie temperature) of the magnetic material according to the invention is still too low for the intended application, a further increase can be attained by replacing a small quantity of Fe (maximally 20 at.%) by Co. Replacement of Fe by Ga, Ni, Si and/or Al also leads to an increase of the $T_c$. However, the effect of the last-mentioned elements on the $T_c$ is smaller than the effect of Co.

Replacement of Fe by a small quantity of Ni, Cu, Mn, Al, Ga and/or Si may be desirable to increase the corrosion-resistance of the $RE_2Fe_{17}C_x$ compounds. The presence of a small quantity of the rare earth metals Pr and/or Nd increases the saturation magnetization of the $RE_2Fe_{17}C_x$ compounds.

The magnetic materials according to the invention can be manufactured in known manner by fusing (for example arc melting) the constituent elements RE, Fe, possibly Co, and C, in the desired proportions to obtain a casting. Since predominantly or exclusively Sm is used as the RE element, the relatively low evaporation temperature requires an excess (10–15% relative to Sm) of said rare earth metal to be used. Subsequently, the casting is subjected to an annealing treatment at 900°–1100° C. in a protective atmosphere (inert gas or vacuum) for at least 5 days. The material thus annealed is then cooled rapidly to room temperature. In this manner, the annealed compounds obtain the desired hexagonal crystal structure of the $Th_2Zn_{17}$-type, and the intended uniaxial anisotropy.

Magnets are manufactured from the annealed known manner. For this purpose, the annealed material is successively ground into a powder, orientated in a magnetic field and pressed to form a magnetic body. It is alternatively possible to disperse the magnetic powder in a liquid synthetic resin, orientate the powder particles by means of a magnetic field and subsequently fix said powder particles in the synthetic resin.

The invention will be explained in more detail by means of the following exemplary embodiments and with reference to the accompanying drawing, in which

DETAILED DESCRIPTION OF PREFERRED EMBODIMENTS

A number of $Sm_2Fe_{17}C_x$ compounds were prepared by means of arc melting. The value of x was in the range from 0.0 to 2.0. The constituent elements (99.9% pure) were combined, in quantities corresponding to the structural formula, in a $ThO_2$ crucible which was introduced into a container at a reduced argon-gas pressure. In view of the quick evaporation, a small additional quantity (10% by weight) of Sm was added. The mixtures were melted by means of an argon arc. The materials thus fused were annealed under a vacuum at 1050° C. for 14 days. The annealed materials were then ground to form powders. X-ray photographs of powder particles orientated in a magnetic field showed that the crystalline materials obtained are single-phase and that they have a uniaxial anisotropy, the magnetization being orientated parallel to the C-axis of the hexagonal crystal structure.

Figure 1:
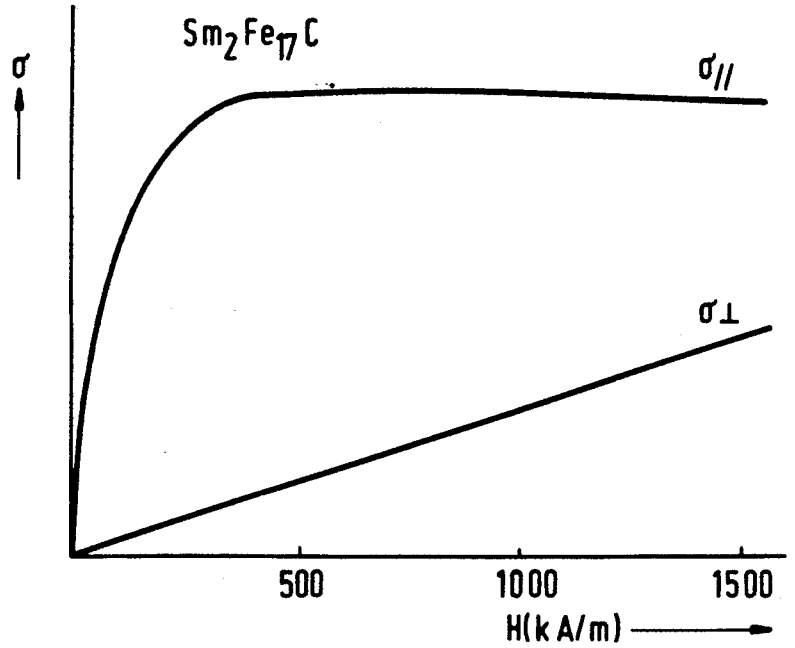
FIG. 1 shows the magnetization $\sigma_{\perp}$ and $\sigma_{11}$ as a function of the applied field H of $Sm_2Fe_{17}C$ at room temperature.
Figure 2:
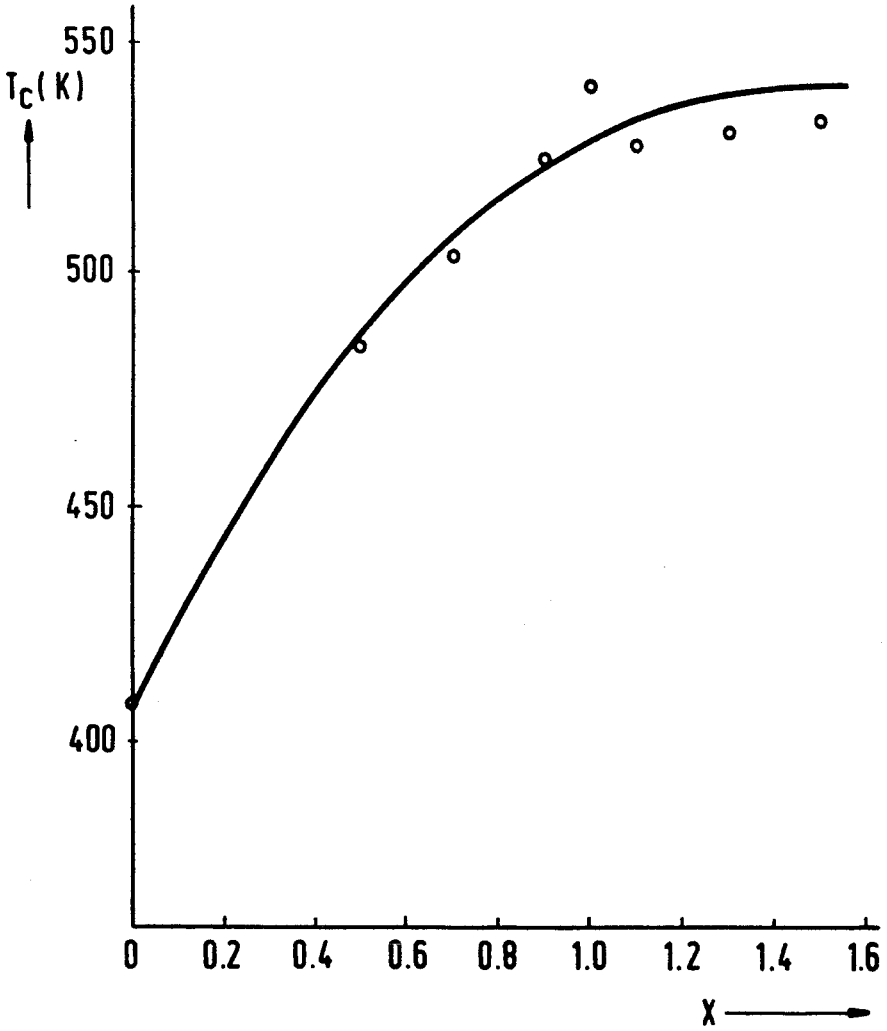
FIG. 2 shows the Curie temperature ($T_c$) as a function of x of the hard magnetic compound $Sm_2Fe_{17}C_x$

The powder particles of the various compositions were, in succession, dispersedly dissolved in a synthetic resin on the basis of polyester, magnetically orientated and fixed. The perpendicular ($\sigma_{\perp}$) and the parallel ($\sigma_{11}$) magnetization were measured on these magnets as a function the field H applied. FIG. 1 shows the results of the measurements carried out on $Sm_2Fe_{17}C$. Taking into account that the alignment of the magnetic particles is not complete, and that there may be some degree of faulty orientation, it can be concluded from extrapolation that the anisotropy field of $Sm_2Fe_{17}C$ amounts to approximately 3200 kA/m (40 kOe). Other types of measurements have shown that the anisotropy field of this compound amounts to 53 kOe at room temperature.

Further it has been found that with this compound the easy axis of magnetization is present throughout the temperature range from 4.2 K to $T_c$.

Comparative examples.

A number of $RE_2Fe_{17}C_x$ compounds, where RE stands for Ho, Dy, Er, Tm, Gd, Y, Yb and Nd, and where $0 \leqq x \leqq 2.0$, was manufactured in the manner described in the exemplary embodiments according to the invention. In these cases no excess of RE was added. By means of X-ray diffraction it was established that the compounds manufactured have a hexagonal crystal structure. The compounds have no or no appreciable uniaxial anisotropy at room temperature.

We claim:

1. A magnetic material having a magnetic phase comprising crystalline $RE_2$-$Fe_{17}$, wherein RE is a rare earth metal, having hexagonal crystal structure and interstitial C dissolved in the magnetic phase in a quantity sufficient to provide the magnetic material with a uniaxial magnetic anisotropy at room temperature, and at least 70 at.% of the rare earth metal consists of Sm.

2. The magnetic material as claimed in claim 1, wherein the composition of said magnetic phase corresponds to the formula $RE_2Fe_{17}C_x$, with $0.5 < x < 3.0$.

3. The magnetic material as claimed in claim 1 or 2, wherein less than 20% of the Fe from the magnetic phase is replaced by Co.

4. A permanent magent comprising magnetic material, as claimed in claim 1 or 2.

5. A permanent magent comprising magnetic material, as claimed in claim 3.

* * * * *